US005456273A

United States Patent [19]

Tungpagasit

[11] Patent Number: 5,456,273

[45] Date of Patent: Oct. 10, 1995

[54] COMB WITH STANDOFF LEGS FOR PRECISION HAIRCUTTING

[76] Inventor: Maneetip Tungpagasit, 1521 Alexander St., Apt. 601, Honolulu, Hi. 96822

[21] Appl. No.: 168,132

[22] Filed: Dec. 17, 1993

[51] Int. Cl.[6] ..... A45D 24/34

[52] U.S. Cl. ..... 132/213.1; 132/214

[58] Field of Search ..... 132/214, 213, 132/213.1, 219

[56] References Cited

U.S. PATENT DOCUMENTS

| | | | |
|---|---|---|---|
| 938,040 | 10/1909 | Caldwell | 132/214 |
| 1,182,242 | 5/1916 | Bennett | 132/234 |
| 1,359,343 | 11/1920 | Dodge | 132/213 |
| 2,556,805 | 6/1951 | Forward . | |
| 3,894,548 | 7/1975 | Suvino | 132/9 |
| 4,830,031 | 5/1989 | Quinones et al. | 132/214 |
| 5,067,502 | 11/1991 | O'Orsi et al. | 132/213.1 |
| 5,131,418 | 7/1992 | Vaccaro | 132/213.1 |

FOREIGN PATENT DOCUMENTS

| | | | |
|---|---|---|---|
| 2385355 | 12/1978 | France | 132/214 |
| 2416668 | 10/1979 | France | 132/214 |
| 2666207 | 3/1992 | France . | |

*Primary Examiner*—John G. Weiss
*Attorney, Agent, or Firm*—David Pressman

[57] ABSTRACT

A comb (10) for precision haircutting includes a pair of removable legs (14) extending orthogonally from its end portions (13). The legs have free ends with feet (16) extending therefrom. In use, the comb is used to comb out and hold a tuft of hair away from a scalp. The feet are placed against the scalp to space the comb a predetermined distance from it. A cutting implement is used to cut the hair above comb, so that the tuft of hair is precisely and evenly cut at an exact length. The widely spaced legs and the feet stably support the comb on the scalp to ensure a precise cut. This procedure is repeated over each area of the scalp for which the hair is to be cut at the same length. Legs of other lengths can be installed for cutting hair at other lengths. Uneven legs (17, 18) can also be installed for spacing the comb at an angle from the scalp, so that tapered cuts can be made.

20 Claims, 1 Drawing Sheet

COMB WITH STANDOFF LEGS FOR PRECISION HAIRCUTTING

BACKGROUND OF THE INVENTION

1. Field of Invention

This invention relates generally to combs, specifically to a comb for precision haircutting.

2. Prior Art

The usual technique for cutting hair involves five small steps: (a) comb out and lift a small tuft of hair with a comb; (b) hold the hair under the comb between two outstretched fingers; (c) measure the cutting length by pulling the fingers a predetermined distance from the scalp; (d) remove the comb; and (e) using the fingers as a straight edge and guide, cut the hair above the fingers.

The most difficult part of this seemingly simple procedure is measuring the cutting length with accuracy and consistency. This problem is further complicated by the fact that a typical hairstyle requires cutting the hair on different areas of the scalp at different lengths. Also hair in some areas, such as the sides of the head and the nape of the neck, require tapered cuts. Therefore the quality of a haircut depends entirely on the skill of the barber or hairstylist.

Special combs have been designed to aid the measuring step by mechanically spacing the comb from the scalp, so that the hair is precisely cut at the desired length. U.S. Pat. No. 2,556,805 (1951) to Forward shows a long handle with a rectangular frame at its distal end (as seen from the front).

After a comb extending from the top of the frame lifts hair from a scalp, the bottom member of the frame is rested on the scalp, so that a clipper is used to cut the hair. However, accurate positioning of the comb is difficult, because the straight bottom member of the frame cannot be stably rested on a curved skull. Furthermore, the long handle makes it awkward to maneuver.

U.S. Pat. No. 4,830,031 to Quinones et al. (1989) shows a U-shaped member which clips onto the spine of a conventional comb. The connected bottom end of the member rests against the scalp to space the comb from it. The comb extends substantially from either side of the much narrower member, so that it is awkward to handle. In addition, the connected bottom end of the member is straight, so that like Forward's device, it also cannot be stably rested on a curved skull.

Published French patent application 2-666-207 to Arraitz (1990) shows a vertically positioned comb whose ends are guided in the grooves of a shoe, which holds and guides an electric clipper. The shape of the shoe determines the angle of the cut, which can range from straight to sharply tapered. As the comb is lifted by the clipper, it lifts and pulls the hair taut at a set distance for the clipper to cut. However, the comb must stay very close to the scalp to catch the hair, so that this device can only be used for cutting hair at very short lengths.

U.S. Pat. No. 5,131,418 to Vaccaro (1992) shows a comb with several flat plates extending orthogonally from the teeth of the comb for spacing it from the scalp. The plates are all of the same size, and are spaced close together. Because a skull is curved, only two of the closely spaced plates will be resting on it at any moment. As a result, the comb can be easily rocked along its length, so that keeping it stable and parallel to the scalp for an even cut will be very difficult.

In conclusion, none of these devices can reliably space a comb from the scalp. Some can be inadvertently positioned with one end closer than the other, so that an uneven cut will result. None cannot be adjusted for spacing the comb at different distances for longer or shorter haircuts. Most can only space the comb parallel to the scalp, albeit unreliably, so that they cannot be used for guiding tapered cuts.

OBJECTS AND ADVANTAGES

Accordingly several objects and advantages of the invention are to provide a comb with standoff legs which lifts a tuft of hair for cutting, which guides a cutting implement to cut the hair very accurately at a desired length, which can be stably and reliably positioned on the scalp to guide the cutting implement for a precise and even cut, which can be easily modified to guide the cutting implement for cutting hair at different lengths or for tapered cuts, which is easy to handle and maneuver, which is simple to produce, and which allows amateurs and professionals alike to cut hair with precision. Further objects and advantages will become apparent from a study of the following description and the accompanying drawings.

DRAWING FIGURES

DRAWING REFERENCE NUMERALS

| | |
|---|---|
| 10. Comb | 11. Spine |
| 12. Teeth | 13. End Portions |
| 14. Legs | 15. Mounting Slots |
| 16. Feet | 17. Leg |
| 18. Leg | |

SUMMARY OF THE INVENTION

A short comb includes a pair of orthogonal legs that snaps onto its ends. The legs are narrow, and have feet at their free ends. The comb is first used to lift out a tuft of hair on a scalp, then the feet are rested against the scalp to space the comb evenly and stably from it at a distance determined by the length of the legs. A cutting implement, such as a pair of scissors or an electric clipper, is guided by the comb for cutting the hair precisely and evenly at the desired length. Legs of different lengths can be used for longer or shorter cuts. Legs of uneven lengths can also be used for tapered cuts.

DESCRIPTION—FIGS. 1A AND 1B—COMB WITH STANDOFF LEGS

Figure 1A:
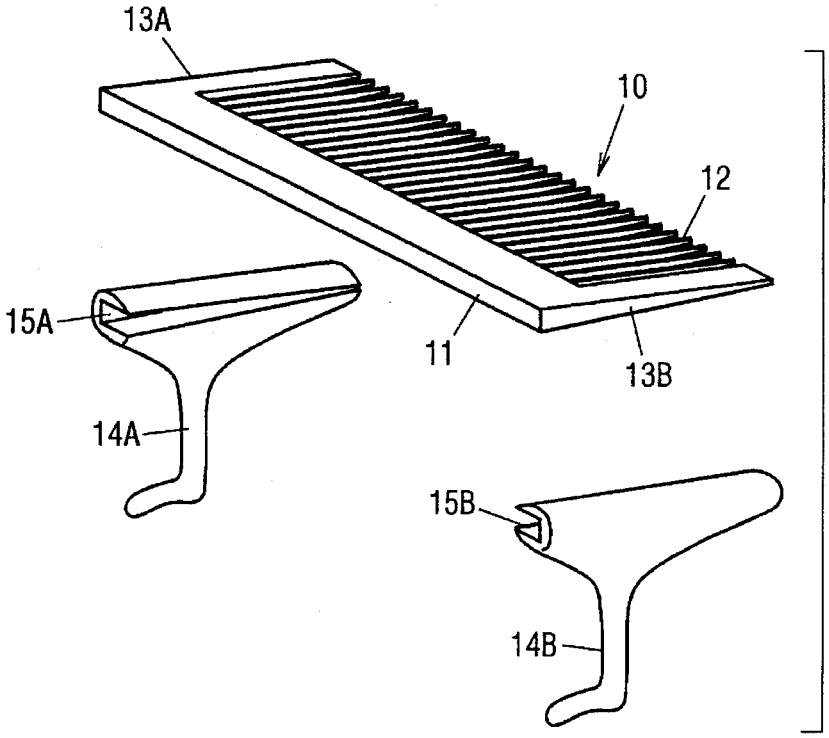
FIG. 1A is a front perspective exploded view of a comb with standoff legs in accordance with a preferred embodiment of the invention.

In accordance with a preferred embodiment of the invention shown in the exploded view in FIG. 1A, a comb 10 includes a spine 11 with a large number of parallel teeth 12 extending therefrom. Spine 11 includes end portions 13A and 13B laterally enclosing teeth 12. A pair of J-shaped standoff legs 14A and 14B include respective mounting slots 15A and 15B on their top ends. End portions 13A and 13B taper down from spine 11 and slots 15A and 15B have corresponding tapers.

Figure 1B:
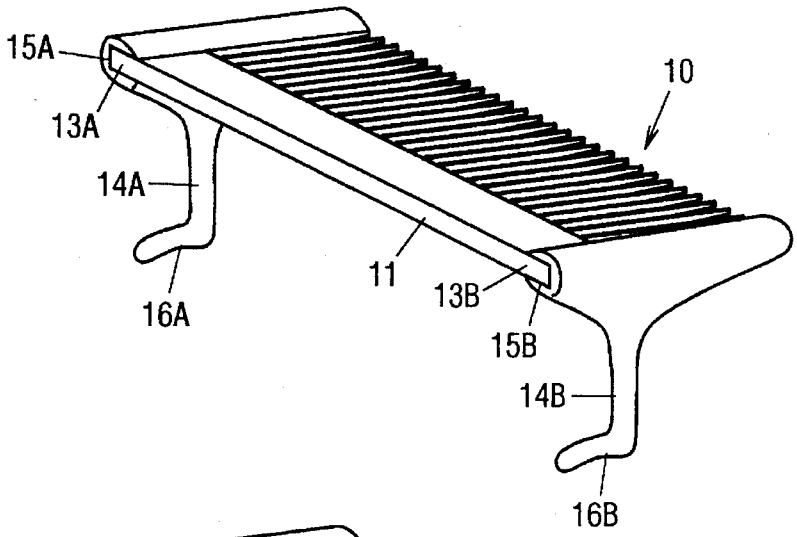
FIG. 1B is a front perspective view of the comb with the legs installed.

Legs 14A and 14B are installed onto comb 10 by fitting or snapping slots 15A and 15B onto its respective end portions 13A and 13B, as shown in FIG. 1B. The thickness of end portions 13A and 13B is slightly greater than the width of slots 15A and 15B, so that legs 14A and 14B will be held onto comb 10 by friction. Alternatively end portions 13A and 13B can have a circular cross section with detents or notches, and slots 15A and 15B can have corresponding cross sections with mating bosses (not shown) which can snap into the detents in the end portions. When installed, legs 14A and 14B are orthogonal to comb 10, and have free lower ends including perpendicular feet 16A and 16B, respectively. The lower edge of feet 16A and 16B are slightly concave to match the convex curve of the scalp. Also all edges of the legs and feet are faired or smooth, so that they can be moved through the hair and over the scalp without snagging or cutting. The tips of feet 16A and 16B are laterally even with the ends of slots 15A and 15B, respectively. Comb 10 is supplied with several pairs of legs, each pair being of a different length (not shown).

In this embodiment, comb 10 can range from 5 cm to 10 cm long, 2.5 cm to 5 cm wide, and 0.3 cm thick. Legs 14A and 14B can range from 0.625 cm to 15 cm long. The simple comb and legs can be inexpensively made of injection molded plastic, cast aluminum, forged steel, or any other suitable material and production method.

OPERATION—FIGS. 1A AND 1B

In use, teeth 12 are pushed briefly along a scalp to comb hair (not shown). Comb 10 is then lifted and simultaneously rotated to lift a tuft of hair (not shown) until it is supported on the scalp by legs 14A and 14B. The legs are positioned orthogonally to the scalp to position comb 10 parallel to it. Comb 10 is thus parallelly spaced from the scalp a distance determined by the length of legs 14A and 14B. Unlike the prior art, some of which use many closely spaced supports, and some use supports with a straight base member, comb 10 uses only two legs. The legs each have a free end, so that they support comb 10 at two points. Being widely spaced apart at the ends of comb 10, legs 14A and 14B positively prevent the comb from rocking along its length. The slightly curved bottoms of feet 16A and 16B conform to the curvature of the skull to further help stabilize comb 10. Feet 16A and 16B are long enough to prevent comb 10 from rocking back and forth.

Thus positioned, comb 10 holds the tuft of hair between its teeth 12. A pair of scissors, an electric clipper, or any other suitable cutting implement (not shown) is used to cut off the excess hair extending above comb 10. Therefore, the tuft of hair is precisely and evenly cut at a length equal to the length of the legs combined with the thickness of comb 10. This procedure is repeated over each area of the scalp on which the hair is to be cut at the same length. Because the comb has legs which are narrow and have free ends, it can be easily handled and moved through the hair.

Legs 14A and 14B can be easily removed, and matching leg pairs of other lengths (not shown) fitted or snapped onto comb 10 for cutting hair on other areas of the scalp at other lengths. For example, longer legs can be used for the top, and shorter legs can be used for the back. This arrangement can be used for most hairstyles, which generally require the back to be cut shorter than the top.

DESCRIPTION—FIG. 2—COMB WITH UNEVEN LEGS

Figure 2:
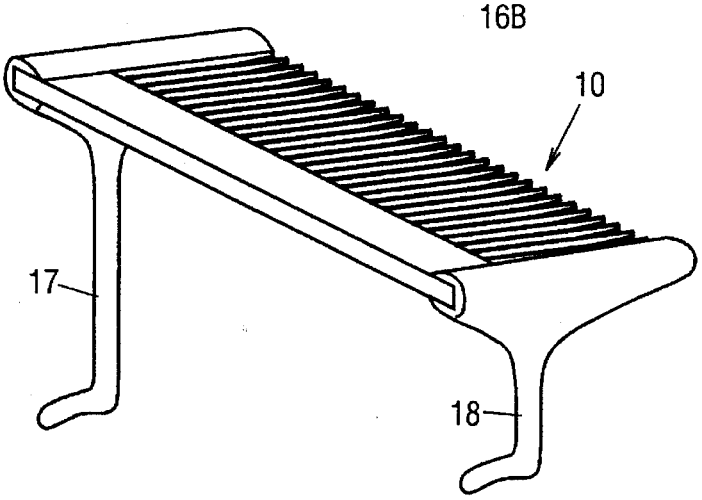
FIG. 2 is a front perspective view of the comb with uneven legs installed.

Many hairstyles also require tapered cuts to be made on the sides and the nape of the neck. This can be achieved by fitting comb 10 with uneven legs 17 and 18, as shown in FIG. 2. These can be selected from two matching pairs of different lengths (not shown). These will space comb 10 from the scalp with one end closer than the other, i.e., at an angle, so that tapered cuts can be made. The amount of taper is determined by the unevenness of the legs.

SUMMARY, RAMIFICATIONS, AND SCOPE

Accordingly the reader will see that I have provided a comb with standoff legs for spacing it a predetermined distance from the scalp for precision hair cutting. When it is holding a tuft of hair upright between its teeth and spaced from the scalp by the legs, a cutting implement can trim the excess hair above the comb, so that the hair is precisely and evenly cut at the desired length. It can be used with legs of different lengths for cutting hair at different lengths around different portions of the scalp. It can be used with legs of uneven lengths for making tapered cuts where they are desired. The legs are widely spaced apart, and have free ends with feet for ensuring precise and stable positioning of the comb on the scalp. The narrow legs with free ends allow the comb to be easily maneuvered through the hair. It allows professionals and amateurs alike to make precision haircuts. It is also very simple and economical to manufacture.

Although the above descriptions are specific, they should not be considered as limitations on the scope of the invention, but only as examples of the preferred embodiment. Many other ramifications and variations are possible within the teachings of the invention. For example, the legs can be made as integral parts of the comb, so that a kit can include several combs each having legs of a unique length, and also include comb with uneven legs. The dimensions of the comb and legs can be altered. The slots in the legs can be rectangular, as can the back sides of these slots. Also the slots can be of uniform width (non-tapered), as can the end portions of the comb. Instead of legs, sledlike ramps or skid standoffs can be used. Therefore the reader is requested to determine the scope of the invention by the appended claims and their legal equivalents, and not by the examples given.

I claim:

1. A comb apparatus for precision haircutting, comprising:

a comb including a spine having plural teeth extending therefrom, said spine having two end portions, only two elongated legs, said two elongated legs extending orthogonally from said two end portions, respectively, of said spine, each of said two elongated legs having an end section distal from its respective end portion of said spine, each end section being free and not attached to any other member so that said distal end sections can be moved over said scalp freely while said distal end sections are in contact with said scalp, even if said scalp is hirsute, whereby when said free end sections of said legs are positioned against said scalp with said legs orthogonal to said scalp, said comb can be used to comb, lift, and stably hold a tuft of hair in said teeth, with an upper portion of said tuft of hair extending above said teeth, so that a cutting implement can be used to evenly cut off said upper portion of said tuft of hair above said comb and a predetermined distance from said scalp.

2. The comb apparatus of claim 1 wherein each of said two elongated legs includes a mounting slot for removably mounting said leg onto its end portion of said spine.

3. The comb apparatus of claim 1 wherein said end section of each of said legs includes a foot extending orthogonally from said leg for stabilizing said comb on said scalp.

4. The comb apparatus of claim 3 wherein each of said feet includes a curved bottom edge for conforming to a curvature of said scalp.

5. The comb apparatus of claim 1 wherein said two elongated legs are of uneven lengths for supporting said comb at a predetermined angle on said scalp, so that when said comb is holding said tuft of hair, said cutting implement can precisely cut off said upper portion of said tuft of hair extending above said comb at said predetermined angle.

6. The comb apparatus of claim 1 wherein said two elongated legs each includes a mounting slot for removably attaching said leg to its respective end portion of said spine, said end section of each leg also including a foot extending orthogonally from said leg for stabilizing said comb on said scalp.

7. The comb of claim 6 wherein each of said feet includes a curved bottom edge for conforming to a curvature of said scalp.

8. A comb apparatus for precision haircutting, comprising:

a comb including a spine having plural teeth extending therefrom, said spine having two end portions, and a pair of elongated legs, each orthogonally and removably attached to a respective end portion of said spine, said pair of elongated legs each having a predetermined length, each of said elongated legs having an end section distal from its respective end portion of said spine, each end section being free and not attached to any other member so that said distal ends can be moved over said scalp freely while said distal end sections are in contact with said scalp, even if said scalp is hirsute, whereby when said free ends of said elongated legs are positioned against said scalp with said legs orthogonal to said scalp, said comb can be used to comb, lift, and stably hold a tuft of hair in said teeth, with an upper portion of said tuft of hair extending above said comb, so that a cutting implement can be used to evenly cut off said upper portion of said tuft of hair above said comb and a predetermined distance from said scalp, and when said pair of legs is removed from said comb, another pair of elongated legs having a different length can be removably attached to said respective end portions of said spine for spacing said comb at a different predetermined distance from said scalp.

9. The comb apparatus of claim 8 wherein each of said elongated legs includes a mounting slot for removably mounting said leg onto its end portion of said spine.

10. The comb apparatus of claim 8 wherein said end section of each of said elongated legs includes a foot extending orthogonally from said leg for stabilizing said comb on said scalp.

11. The comb apparatus of claim 10 wherein each of said feet includes a curved bottom edge for conforming to a curvature of said scalp.

12. The comb apparatus of claim 8 wherein said elongated legs are of uneven lengths for supporting said comb at a predetermined angle on said scalp, so that when said comb is holding said tuft of hair, said cutting implement can precisely cut off said upper portion of said tuft of hair extending above said comb at said predetermined angle.

13. The comb apparatus of claim 8 wherein said elongated legs each include a mounting slot for removably attaching said leg to its respective end portion of said spine, said end section of each leg also include a foot extending orthogonally from said leg for stabilizing said comb on said scalp.

14. The comb of claim 13 wherein each of said feet includes a curved bottom edge for conforming to a curvature of said scalp.

15. A comb apparatus for precision haircutting, comprising:

a comb including a spine having plural teeth extending therefrom, said spine having two end portions, and a pair of legs each comprising generally an elongated member extending orthogonally from a respective end portion of said spine, each of said legs having an end section distal from its respective end portion of said spine, each end section of each leg including an elongated foot extending orthogonally to said leg, each end portion of each leg being free and not attached to any other member so that said end sections, including said feet, can be moved over said scalp freely while said end sections are in contact with said scalp, even if said scalp is hirsute, whereby when said free end sections of said legs are positioned against said scalp with said legs orthogonal to said scalp, said comb can be used to comb, lift, and stably hold a tuft of hair in said teeth, with an upper portion of said tuft of hair extending above said comb, so that a cutting implement can be used to evenly cut off said upper portion of said tuft of hair above said comb and a predetermined distance from said scalp.

16. The comb apparatus of claim 15 wherein each of said legs includes a mounting slot for removably mounting said leg onto its end portion of said spine.

17. The comb apparatus of claim 15 wherein each of said feet includes a curved bottom edge for conforming to a curvature of said scalp.

18. The comb apparatus of claim 15 wherein said legs are of uneven lengths for supporting said comb at a predetermined angle on said scalp, so that when said comb is holding said tuft of hair, said cutting implement can precisely cut off said upper portion of said tuft of hair extending above said comb along said predetermined angle.

19. The comb apparatus of claim 15 wherein said legs each include a mounting slot for removably attaching said leg to its respective end portion of said spine, said end section of each leg also include a foot extending orthogonally from said leg for stabilizing said comb on said scalp.

20. The comb apparatus of claim 15 wherein said legs, including said feet thereof, are faired for facilitating movement through the hair and scalp.

* * * * *